United States Patent [19]

Palmer

[11] Patent Number: 4,936,590

[45] Date of Patent: Jun. 26, 1990

[54] PITCH GAME

[76] Inventor: Robert C. Palmer, P.O. Box 156, Forest Ranch, Calif. 95942

[21] Appl. No.: 197,999

[22] Filed: May 24, 1988

[51] Int. Cl.[5] ..... A63B 67/06

[52] U.S. Cl. ..... 273/402; 273/285; 273/DIG. 24; 273/DIG. 30

[58] Field of Search ..... 273/398–402, 273/DIG. 24, DIG. 30, 285, 375, 1.5 R

[56] References Cited

U.S. PATENT DOCUMENTS

| | | | |
|---|---|---|---|
| 1,328,711 | 1/1920 | Carr | 273/285 |
| 2,050,914 | 8/1936 | Anderson | 273/401 |
| 3,077,677 | 2/1963 | Malkin et al. | 273/285 X |
| 3,628,793 | 12/1971 | Mudloff | 273/402 |
| 3,971,560 | 7/1976 | Panosh | 273/DIG. 24 X |
| 4,036,494 | 7/1977 | Hayes | 273/1.5 R |
| 4,130,284 | 12/1978 | Fuks | 273/285 X |
| 4,133,531 | 1/1979 | Arteaga et al. | 273/395 |
| 4,254,952 | 3/1981 | Playter, Jr. | 273/401 X |
| 4,552,357 | 11/1985 | Di Egidio | 273/285 X |
| 4,565,375 | 1/1986 | Dressel | 273/401 |
| 4,709,929 | 12/1987 | Mills et al. | 273/402 |
| 4,736,955 | 4/1988 | Pollock | 273/DIG. 24 X |

FOREIGN PATENT DOCUMENTS

| | | | |
|---|---|---|---|
| 532082 | 11/1921 | France | 273/399 |
| 2446465 | 9/1980 | France | 273/DIG. 24 |

*Primary Examiner*—Paul E. Shapiro

[57] ABSTRACT

The portable pitch game of the present invention is a self-contained target/toss-type game comprised of two multi apertured rectangular platforms. Colored apertured disc projectiles are supplied in sets of six, one set for each player. A player stands on the edge of one platform and tosses discs in an attempt drop them through one of the apertures in the second platform. The apertures are scored one, two, three according to distance away from the thrower. Separable hinges and latches are included for attaching the two rectangular platforms together into a storage or carrying case. In a special embodiment, the discs and a ring around the apertures are colored with a non-toxic light chargeable coating which produces a glow effect in a darkened environment.

12 Claims, 2 Drawing Sheets

PITCH GAME

BACKGROUND OF THE INVENTION

1. Field of the Invention

This invention relates to pitch games utilizing disc-type throwing devices and a standing platform designed to catch and retain the discs according to the skill of the thrower.

2. Description of the Prior Art

A past art patent search was conducted and the patents which appeared to me to be most pertinent to my invention included:

A patent issued to Thomas, dated Aug. 11, 1885, U.S. Pat. No. 324,189 shows a parlor game using an upward projecting cup mounted on a platform and projectile rings.

The Whitney patent, dated Nov. 9, 1897, U.S. Pat. No. 593,343, illustrates various sized cups mounted on a platform and using discs as the projectiles.

Anderson was issued U.S. Pat. No. 2,050,914, on Aug. 11, 1936, on the "Game Board", which consists of a flat ringed game board with a center aperture and flat discs.

U.S. Pat. No. 2,126,245, dated Aug. 9, 1838, to Darby, illustrates a beveled disc as the projectile and a collapsible bag as the target.

Gross was issued U.S. Pat. No. 3,363,899, dated Jan. 16, 1968, for a game utilizing a disc projecting board and a multiple cup receptacle.

A patent issued to Ogg, U.S. Pat. No. 3,964,745, dated June 22, 1976, illustrates a spring mounted pitching deck with one embossed receptacle and disc type projectiles.

On Mar. 15, 1977, Blasingame was issued U.S. Pat. No. 4,012,042, for "Invertible Pocketed Target For A Disc Throwing Game".

U.S. Pat. No. 4,169,596, dated Oct. 2, 1979, was issued to Chinenson for a game comprising one bowl shaped receptacle and convex shaped projectiles.

The Brown patent, dated May 27, 1980, U.S. Pat. No. 4,204,682, illustrates a game using a below ground level receptacle and ringed discs as projectiles.

Dresel was issued U.S. Pat. No. 4,565,375, dated Jan. 21, 1986, for a game apparatus which uses a one apertured receptacle box and projectile discs.

To my knowledge, the previously mentioned patents represented devices most pertinent to my invention. Although many target/toss-type games are in use and on occasion, new ones developed, the device encompassed in my invention is to be considered a more recent innovation in this area. Even though pitch games or target/toss-type games are necessarily somewhat similar, having receptacles and projectiles of some nature, and all requiring some degree of skill or dexterity to play the game, there are innovations and improvements contained in my invention which, I feel, prove to be of considerable advantage over the previously mentioned past art patents. Most of the previous inventions include scoring point values for concentric distances surrounding the target receptacles and therefore have scoring values for near misses. Some of the devices are not portable, being designed to be used outside and installed below ground level, while others require some degree of assemblage. Most of the previously patented games do not incorporate storage or carrying cases into their design, and none provide standing areas for the players.

SUMMARY OF THE INVENTION

In practicing my invention, I have developed a portable, self-contained target/toss-type game comprised of two, multi apertured rectangular platform receptacles and a multiple of flat, apertured, colored disc projectiles. In a special embodiment, the discs are colored with a non-toxic light chargeable coating which produces a glow effect in a darkened environment and the apertures in the receptacle platform are ringed with a similar coating. A player selects a set of like colored discs easily discernable from differently colored sets of discs selected by competitors. The object of the game is to throw the discs with the purpose of having them pass through one of the three apertures located on the platform receptacle and be retained under the platform in a compartment for that particular aperture. A very simplistic scoring method is incorporated into my game which is designed for easy use by children. A point value of one for the closest aperture, two for the middle aperture, and three for the farthest aperture with the winner being the one with the highest score of similarly colored retained discs. The retained discs can be recovered after all players have tossed from walled areas forming compartments for each aperture. My device is also easily portable, providing a carrying and storage case, a standing platform, and the disc receptacles all within the structured framework of the game itself.

Therefore, it is a primary object of my invention to provide a target/toss-type game with accompanying apparatus and method for playing the game.

Another object of my invention is to provide a target/toss-type game that is simple to use and depending on the distance placed between the player and the target, may require a low to high level of expertise or skill to play the game.

A further object of my invention is to provide a portable target/toss game which is self-contained and provides both the gaming apparatus and storage case all in the same structure, thereby avoiding the problem of loosing small pieces of the game when not in use or trying to find the case when needed.

A still further object of my invention is to provide a portable game which can be used indoors or outside.

An even further object of my invention is to provide a target/toss game which requires no assemblage of parts prior to use, simply a separation and placement of the two platforms, which is therefore easier for children to use.

Another further object of my invention is to provide a target/toss game with a standing platform with a nonslip surface which is incorporated into the framework of the game itself. This standing platform delineates the base line from which the user throws the disc, whereby any overstepping of the "line" would prove obvious.

An even further object of my invention is to provide a target/toss game with six different color groups of six discs each, therefore making it possible for all players to take a turn before the discs must be retrieved.

Other objects and advantages of my invention will be better understood with a reading of the numbered parts described in the specification and subsequent comparison with similarly number parts shown in the accompanying drawings.

DRAWING REFERENCE NUMERALS

Figure 1:
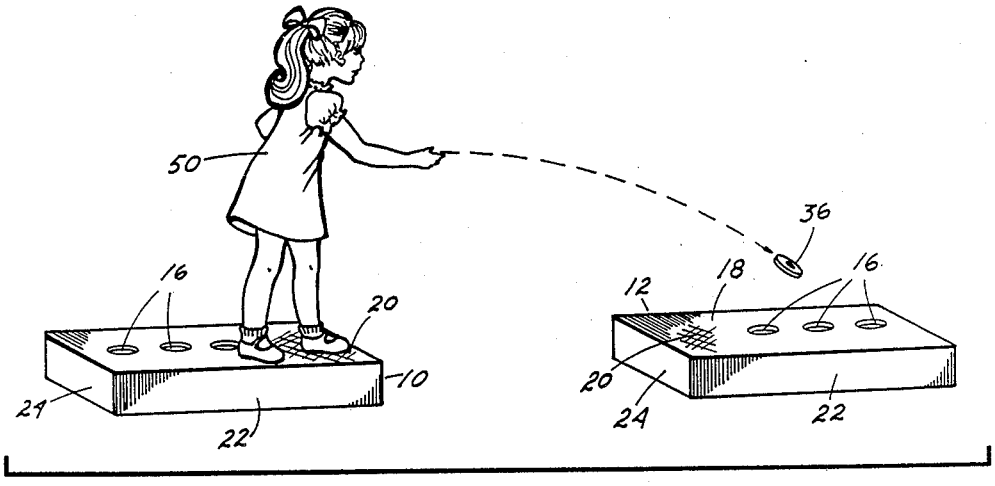
FIG. 1 shows a perspective view of the preferred embodiment of the invention in use.

10 case-target platform one
12 case-target platform two
14 storage case
16 target apertures
18 platform top
20 standing area
22 platform side walls
24 platform end walls
26 platform bottom
28 interior walls
30 disc receptacle one
32 disc receptacle two
34 disc receptacle three
35 disc compartments
36 washer-type discs
37 disc straps
38 male-side hinge
40 female-side hinge
42 left rope handle
44 hooked-surface Velcro fastener
46 looped-surface Velcro fastener
48 right rope handle
50 player
52 combined hinge
54 clamp latch fasteners
56 glow coated colored discs
58 glow coated aperture edges

DESCRIPTION OF THE PREFERRED EMBODIMENT

Referring now to the drawings at FIG. 1 where the preferred embodiment of the invention is in use. Case-target platform one 10 is positioned for player 50 to stand on platform top 18 in the game standing area 20. Case-target platform two 12 is positioned with target apertures 16 upwardly at a distance compatible with the skill of player 50 or at a specified distance for tournament play. Player 50 tosses washer-type disc 36 trying to hole disc 36 in one of the target apertures 16. The target apertures 16 are designated receptacle 1, 2, and 3 and the game is scored 1 point for receptacle 1, two points for receptacle 2, and three points for receptacle 3. The simplicity makes this particular game fun to play easy to score, and convenient to store.

Figure 2:
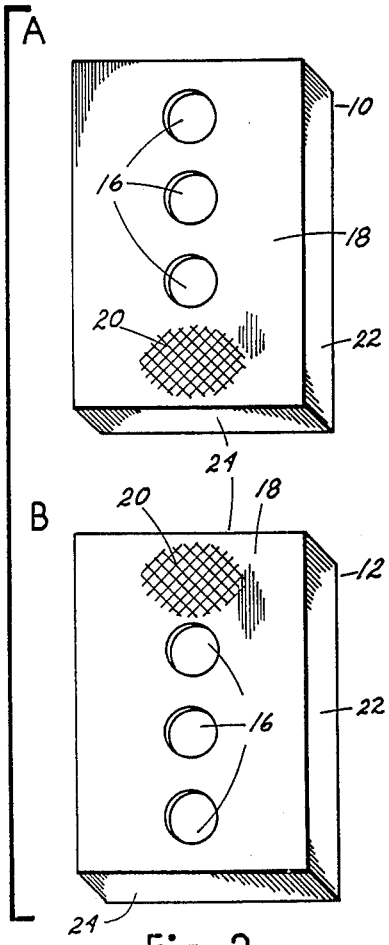
FIG. 2 illustrates a perspective top view of the two target platforms and the relative position of the apertures.
Figure 3:
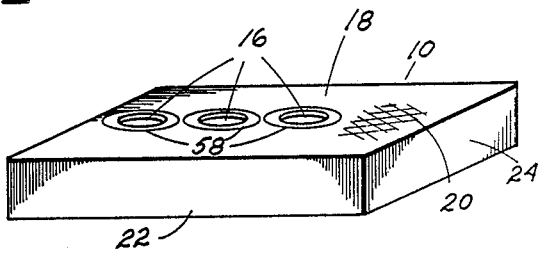
FIG. 3 illustrates a perspective side view of the invention and glow coated aperture edges are indicated by dotted lines.
Figure 4:
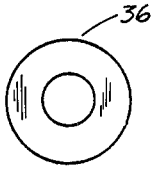
FIG. 4 is a top view of washer disc projectile.
Figure 5:
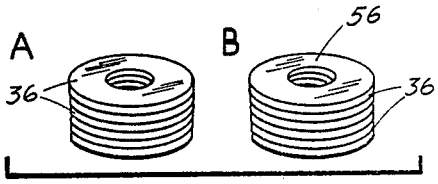
FIG. 5 illustrates two sets of six washer discs projectiles with A illustrating a regulation play set of colored discs and B illustrating a regulation play set of special light-glow coated discs.
Figure 6:
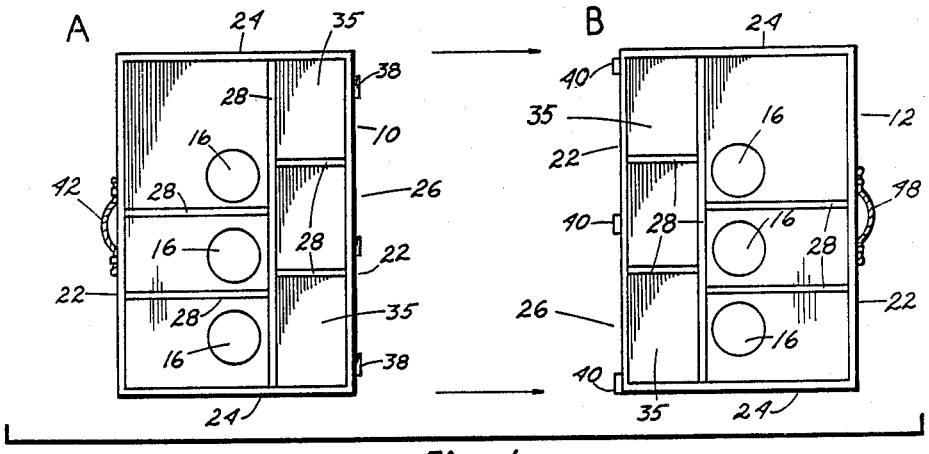
FIG. 6 A is a bottom view of the left target platform showing the male portion of the take-apart hinge, and B showing the right target platform with the female portion of the take-apart hinge.
Figure 7:
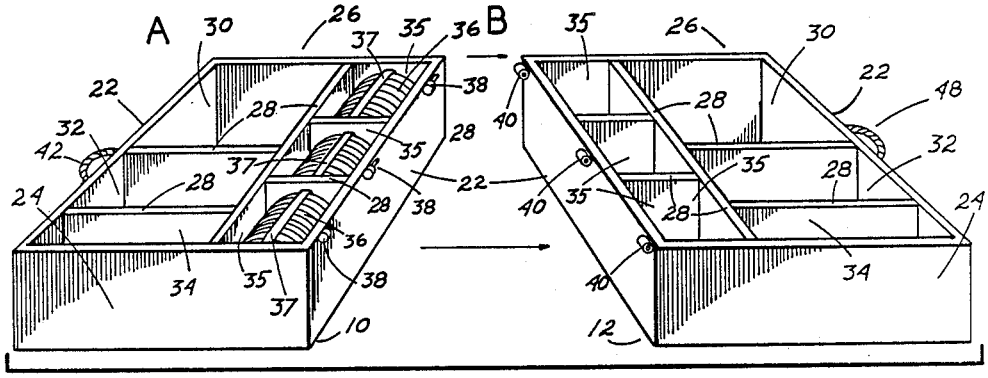
FIG. 7 is a perspective bottom view of the two connecting target platforms showing the disc compartments, hinges and carrying handles.
Figure 8:
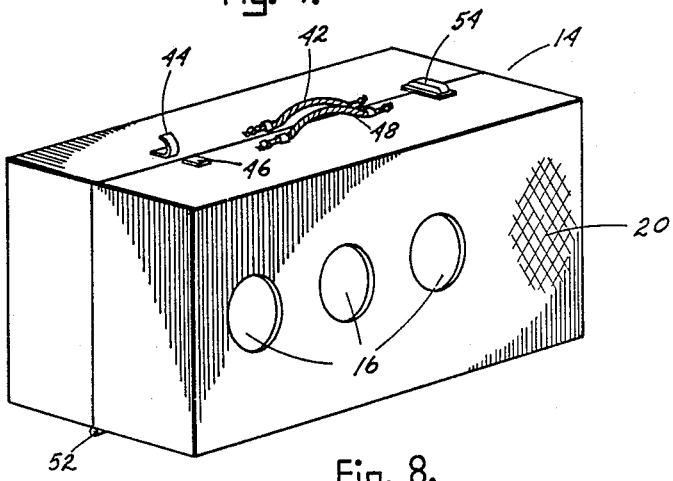
FIG. 8 is an assembled perspective view of the game in its portable, storage form.

In the preferred embodiment, case-target platform one 10 and case-target platform two 12, as seen in FIG. 2, 6, and 7, together make up both the disc receptacles and storage case 14, shown in FIG. 8. They are constructed of a plastic or other suitable material into two rectangular box frames each having three target apertures 16 located on each platform top 18, depicted in all Fig.'s but 4 and 5. Target apertures 16, although equidistance from one another, are located closer to one end of the platform top 18, leaving an enlarged area on the opposite end which forms standing area 20. Standing area 20 is textured to prevent slipping, as shown in FIGS. 1 & 2. Each platform also consists of platform side walls 22, platform end walls 24, partially open platform bottom 26, and five interior walls 28, as seen in FIG. 7. Three of the five interior walls 28 form three separate compartments, the first and largest being disc receptacle one 30, the second being disc receptacle two 32, and the last being disc receptacle three 34. Disc compartments 35 are also formed by interior walls 28, and are designed to store washer-type discs 36 held by disc straps 37, better seen in FIGS. 6 and 7. All three disc receptacles have one target aperture 16 located in the ceiling through which washer-type discs 36 are tossed and retained, shown in FIG. 6. Case-target platform one 10 contains three male-insertion hinges 38 on the bottom edge of the left side, which aligns and connects with three female-insertion hinges 40 which are located on the bottom edge of the right side of case-target platform two 12, as pictured in FIGS. 6 and 7. Located on the bottom center edge of the right side of case-target platform one 10 is left rope handle 42, and situated to either side is one hooked-surface velcro fastener 44. The bottom edge of the left side of case-target platform two 12 contains two looped-surface Velcro fasteners 46 with right rope handle 48 centered in between the two, as depicted in FIGS. 6, 7, and 8.

To utilizing my invention, case-target platform one 10 is placed a desired distance from case-target two 12 with standing area 20 of both platforms facing each other. The washer-type discs 36 are divided by color among one to six players 50. Each player 50 stands on standing area 20 of one platform and tosses his or her six washer-type discs 36, aiming to place it into one of the three target apertures 16 located on the other platform. All players finish one turn each and then the score is calculated. When the game is completed, all washer-type discs 36 are placed within washer-disc compartments 35, held in place with disc straps 37, and case-target platform one 10 is attached to case-target platform two 12 by female-side insertion hinge 38 and male-side insertion hinge 36, and closed together, creating combined hinge 52 and storage case 14. Hooked-surface Velcro fastener 44 is removably attached to looped-surface Velcro fastener 46, which holds storage case 14 closed. Storage case 14 can now be carried by both left rope handle 42 and right rope handle 48. Metal or plastic clamp latch fasteners 54 can be used in place of the Velcro fasteners.

A second embodiment of the invention is similarly structured and differs only in that the coloring of the washer type discs 36 is of a non-toxic fluorescent glow coat finish 56 which produces a glow effect in a darkened environment. Edges around the target apertures 16 in case-target platform one 10 and case- target platform two 12 are aligned with the same non-toxic fluorescent glow coat finish 58.

Although I have described my invention with considerable details in the specification, it is to be understood that changes in the design and in the structure of the invention may be made so long as the changes do not exceed the intended scope of the appended claims.

I claim:

1. A game apparatus comprising;

two substantially rectangular, five-sided receptacles each having a top portion, two side portions, two end portions, five interior walls and an open bottom portion thereof;

said top portion of said two receptacles each having three aligned and spaced apertures therein;

a textured standing area on one end of said top portion of each said two receptacles;

a hinging means longitudinally arranged for removably attaching said two receptacles with said open bottom portion thereof interfacing;

a fastening means for removably attaching said two receptacles oppositely from said hinging means forming said two receptacles into a temporarily retained single container;

a grip-type carrying means for both said receptacles;

a multiple of washer-shaped disc sized to pass readily through one of said apertures when accurately tossed, an elastic strap retainer for holding said discs in sets of six secure inside said two receptacles.

2. The apparatus of claim 1 wherein three of said five interior walls form three distinct disc separating compartments there being one of three said apertures opening into each said disc separating compartment.

3. The apparatus of claim 2 wherein said three of the said five interior walls form three separate disc storage compartments sized for retaining said washer-shaped discs in set of six.

4. The apparatus of claim 1 wherein one said five-sided receptacle has as a first cooperative half of saic hinging means a multiple of female-insertion hinge: permanently affixed to a longitudinal bottom edge thereof.

5. The apparatus of claim 4 wherein one said five-sided receptacle has as a second cooperative half of saic hinging means a multiple of male-insertion hinges per manently affixed to the bottom edge thereof.

6. The apparatus of claim 1 wherein said fastening means oppositely from said hinging means is two pair: of cooperative Velcro fasteners.

7. The apparatus of claim 1 wherein said fastening means oppositely from said hinging means is two pair: of cooperative clamp latch fasteners.

8. The apparatus of claim 1 wherein said two five sided receptacles releasably attach to one another by said said hinging and said oppositely positioned fasten ing means forms an openable compartmented storage case for said discs and other game paraphernalia.

9. The apparatus of claim 1 wherein said grip-type carrying means for said storage case are two rope han dles permanently attached one to each side adjacen said fastening means on the longitudinal surfaces of side five-sided receptacles with said rope handles positionec to come together as a single handle when said storage case is in the closed position.

10. The apparatus of claim 1 wherein said discs are supplied in sets of six with each disc in each set colorec distinctly for the individual set and each set colorec differently from the other sets used in said game.

11. The sets of six discs with each disc set colorec differently of claim 9 wherein said coloring is appliec with a non-toxic fluorescent glow-type paint coating.

12. The apparatus of claim 1 wherein said aligned anc spaced apertures are provided with a non-toxic fluores cent glow-type coating along exposed edges and as a narrow collar around the outer surface top thereof.

* * * * *